United States Patent [19]

Princiotta, Sr. et al.

[11] Patent Number: 4,712,787

[45] Date of Patent: Dec. 15, 1987

[54] STACKING APPARATUS

[76] Inventors: Raymond A. Princiotta, Sr., 208 N. Concord Ave., Havertown, Pa. 19083; Antonio Salvucci, 131 Windswept Dr., Feasterville, Pa. 19047

[21] Appl. No.: 851,107

[22] Filed: Apr. 14, 1986

[51] Int. Cl.[4] ..... B65H 29/54

[52] U.S. Cl. ..... 271/311; 271/84; 271/176; 271/191; 271/182; 271/217; 414/85

[58] Field of Search ..... 198/463.1; 414/82, 85; 221/259, 267; 271/307, 308, 311, 190, 191, 198, 84, 207, 116, 267, 81, 272–274, 176, 182, 217

[56] References Cited

U.S. PATENT DOCUMENTS

| | | | |
|---|---|---|---|
| 2,959,412 | 11/1960 | Sjostrom | 271/84 |
| 3,281,146 | 10/1966 | Bridge | 271/191 |
| 3,370,849 | 2/1968 | Martin | 271/176 |
| 3,567,047 | 3/1971 | Clausen | 271/191 X |
| 3,618,546 | 11/1971 | Preston | 271/84 X |
| 3,957,175 | 5/1976 | Gordon | 221/267 X |
| 4,157,823 | 6/1979 | Morton | 271/84 X |

FOREIGN PATENT DOCUMENTS

| | | | |
|---|---|---|---|
| 314943 | 9/1969 | Sweden | 414/85 |

*Primary Examiner*—Joseph J. Rolla
*Assistant Examiner*—Gregory L. Huson
*Attorney, Agent, or Firm*—Lipton & Famiglio

[57] ABSTRACT

An automatic stacking machine is disclosed. The machine is designed to stack pieces of cloth, prior to the use of the cloth in the construction of garments. A conveyor, having a plurality of bands, transports the cloth pieces to a horizontally reciprocal carriage that reciprocates from a position under the conveyor. Located below the reciprocal carriage, when it is in its extended position, is an elevator table upon which the cloth pieces are deposited and stacked. A plurality of wheels, mounted above the retractable carriage, in its extended position, turn in the direction of outward movement of the carriage. When the carriage changes direction and begins to retract, the wheels, which only move in one direction, pull the fabric off the retractable carriage and the cloth drops neatly down on the table below.

7 Claims, 5 Drawing Figures

STACKING APPARATUS

BACKGROUND OF THE INVENTION

1. Field of the Invention

This invention relates to automatic stacking machines in general. In particular, the invention relates to machines for automatically stacking relatively thin, flat objects such as pieces of cloth which are used in constructing garments and the like.

2. Description of the Prior Art

There are various problems with stacking machines used in the garment industry today. Many such machines use gripping devices to place cloth pieces in a stack. Although such machines are effective in forming a stack of cloth pieces, they result in creases, or marks, or other imprints being placed in each individual piece of cloth. Such imprints, of course, may appear in the finished garment. Although pressing may, in some cases, eliminate or reduce the magnitude of such imprints, they are frequently left in the finished garment, thereby detracting from its appearance.

Other stacking machines used in the garment industry permit the pieces of fabric to fall without guidance to a receiving platform or table. The result of this approach is that the individual pieces are not neatly aligned with one another, thereby resulting in an irregular stack. Such an irregular stack makes it difficult to proceed with subsequent automated steps in the manufacture of garments. In order to reduce the degree of the misalignment between the pieces of cloth in such machines, the distance between the conveyor and the receiving platform is limited. As a result, such machines are limited to stacks of cloth no higher than seven inches.

Many present strapping machines use gripping devices to align the fabric with fabric that is already stacked. However, these gripping devices create marks on the fabric which may show up in the final fabric. It would be convenient to be able to align the fabric using a method or apparatus that does not create such marks on the fabric.

U.S Pat. No. 3,370,849, issued on Feb. 27, 1968 to F. C. Martin, discloses a stacking apparatus having a reciprocating table. Martin differs from the present applicant's disclosure in that the fabric in Martin moves from a horizontal conveyor to a system of conveyor belts located at an angle slanting downward from the horizontal conveyor. In Martin, the receiving table itself reciprocates so as to form a stack of folded fabric. By contrast, present applicant's invention is used to stack an unfolded sheet of fabric. A wheel is used in Martin to retain alignment and prevent slippage of the fabric as the fabric is carried frictionally down the slanted conveyor belt system. In the present invention, the wheel serves not only a guiding function but momentarily holds the fabric as a reciprocating carriage, upon which the fabric is moving, changes direction.

It is the object of the present invention to provide an automatic stacking machine which stacks pieces of cloth without the use of means which will grip the pieces and create marks on the fabric, but with the use of wheels to guide and align the fabric as it leaves the reciprocating carriage so as to stack it more efficiently on a stacking table.

It is another object of the present invention to provide an automatic stacking machine of the type having a conveyor and a reciprocating carriage which can stack pieces of fabric which are wider than the conveyor.

It is another object of the present invention to provide a stacking machine with a stacking table of adjustable height.

SUMMARY OF THE INVENTION

In accordance with the invention, an automatic stacking machine having an endless conveyor and a reciprocating carriage is provided. The carriage, with a table surface on top, is located under the conveyor and reciprocates on a pair of tracks connected to a frame. The conveyor feeds pieces of cloth to the surface on the carriage. A stationary stacking table of the elevator type is located next to the frame and is below the carriage as the carriage moves out to its extended position. A plurality of guide wheels are suspended over the carriage and they turn in the direction of movement of the carriage as it extends outward. When the moveable carriage retracts, the wheels which do not change direction, momentarily clutch the fabric prior to its release to the stacking table. The guide wheels help to draw the fabric off from the carriage to align the fabric on the stacking table.

Photoelectric cells are used to control the reciprocation of the carriage. After the fabric is deposited from the conveyor on to the surface of the carriage, the fabric is guided by one or by a plurality of suspended clutch wheels, moving in the direction of movement of the carriage, as it extends out from under the conveyor. At the time that the carriage reverses itself, the clutch wheels located above the carriage, as they can only move in one direction, momentarily grip the fabric and draw it off the reciprocating carriage, causing it to move to the stacking table. Through the use of photoelectric cells to control horizontal travel of the carriage, the length of travel automatically adjusts itself to the length of cloth being deposited. The carriage normally moves at the same speed as the upper portion of the conveyor which transports the pieces of cloth.

Other objects and advantages of the invention will become apparent upon reading the following detailed description and upon reference to the drawings.

DESCRIPTION OF THE PREFERRED EMBODIMENT

Figure 1:
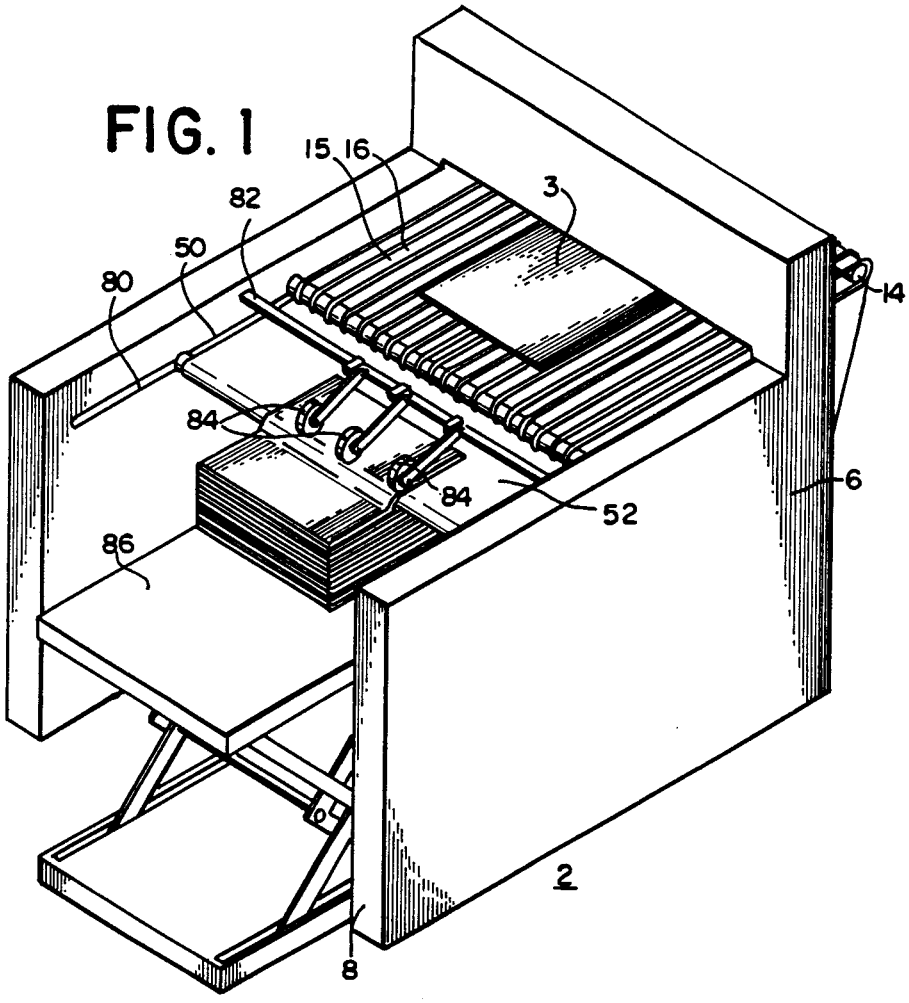
FIG. 1 is a front view of the invention.
Figure 2:
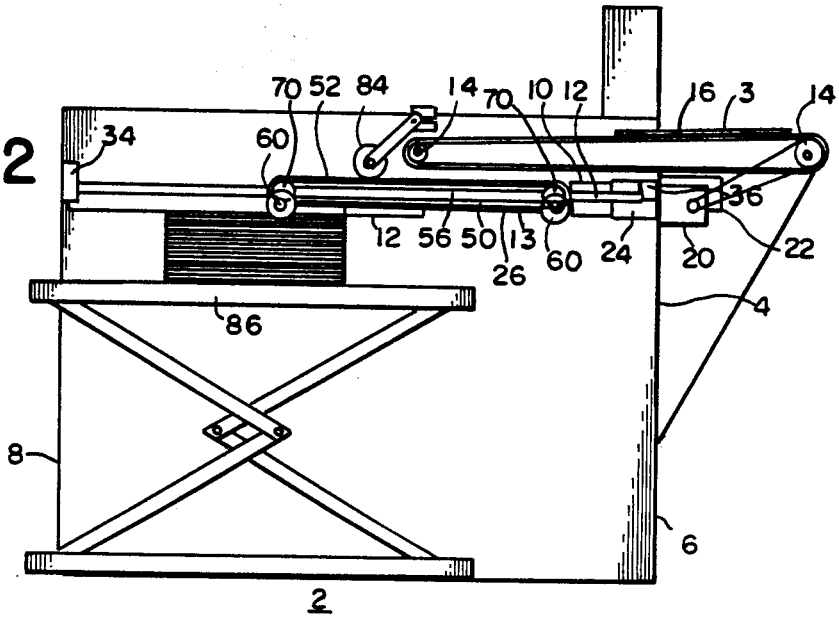
FIG. 2 is a side view of the invention.

Referring now to FIGS. 1 and 2, there are shown a front view and side elevation view of the present invention. The stacking Machine 2 includes a frame 4, having a pair of rear legs 6 and a pair of front legs 8, connected by a pair of rails 13.

The conveyor 15 is connected to the rear legs. The conveyor includes horizontal members 10 which connect the rear legs 6 to rails 13. Bands 16 are equally spaced from one another and are preferably constructed of plastic tubing. The rollers 14 have groves therein to receive the bands 16. It is to be understood that a single band, substantially as wide as the length of rollers 14, could be used in lieu of bands 16. An electric motor 20 is connected to the frame 4. A drive chain 22 engages the rear roller 14 and the motor 20 so that the motor 20 may cause rotation of the rear roller, hence causing the lower portion of the bands 16 to move forward, thereby causing piece of cloth 3 to move forward. Of course, the forward roller 14 is caused to rotate by the movement of band 16.

A carriage 50, which supports a surface 52, rests on rails 13. The carriage includes a pair of side members 56 which each have wheels 60 rotatibly connected thereto, by a suitable means. The wheels 60 rest on rails 13. The side members 56 are connected to one another by forward and rearward cross members 70.

Figure 3A:
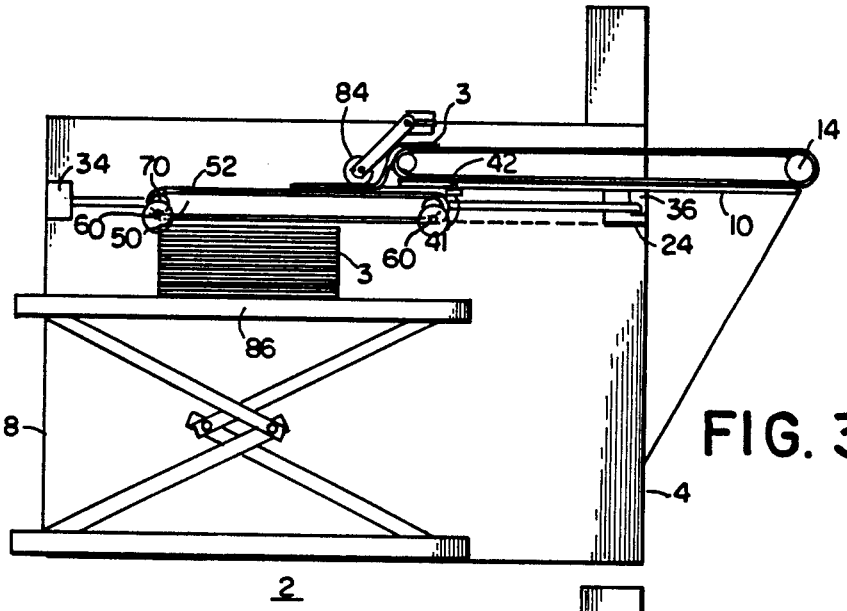
FIGS. 3*a* to 3*c* shows schematically the operation of the invention.
Figure 3B:
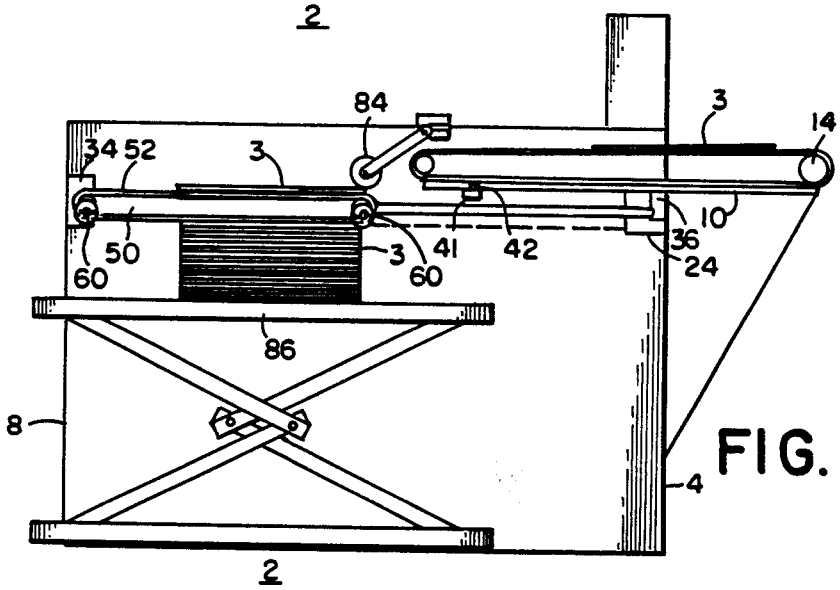
Figure 3C:
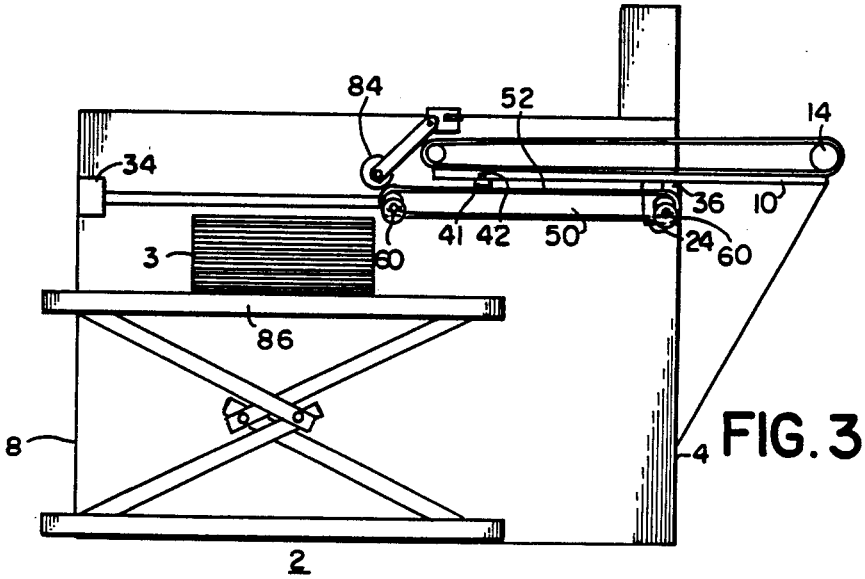

The carriage 50 is caused to move horizontally along the rails 13 by electric motor 24 which is connected to one of the rear legs 6. The electric motor 24 drives a chain 26 which runs the length of the frame. The forward end of the chain 26 is looped about a supporting gear or roller not shown. The chain 26 is positioned within one of a pair of inverted, u-shaped members 12 which are connected to the front legs 8 and rear legs 6. A bracket not shown is connected to the lower portion of chain 26 and to the carriage 50, thereby permitting movement of the chain to cause horizontal movement of the carriage along the rails 13. As may be seen in FIG. 2 extreme forward motion of the carriage is stopped by light switch 34 which is connected to one of the forward legs 8 and which is activated by it being impacted by the carriage 50. Similarly, rearward motion of the carriage 50 is stopped by the rear limit switch 36 which is connected to one of the rear legs 6 and which is activated by the impact of the carriage 50. Forward and rearward motion of the carriage, with the table surface attached, is controlled by an upward facing photoelectric cell 42. As is shown in FIG. 3 (*a*), the photoelectric cell 42 is connected to a cross piece 41 which is connected at its opposite ends to the roller support members 10. The upward facing photoelectric cell 42 is positioned midway between the support members and below the upper portion of the bands 16. In the preferred embodiment of the invention, the photoelectric cell 42 receives light from normal room lighting. However, if necessary, special lighting may be provided.

In its normal stacking mode, the carriage 50 is positioned in its rearward position and the machine is turned on. Pieces of cloth 3 which are to be stacked are placed sequentially on the rear portion of the conveyor 15. When the forwardmost portion of the piece of cloth 3 passes over the photoelectric cell 42, an electrical signal is provided to cause the motor 24 to move the table 52 forward at the same rate of speed as the upper portion of the band 16. As the upper portion of the conveyor bands and the table 52 move forward, the cloth 3 is deposited on the table 52. As the rear edge of the piece of cloth 3 passes over the photoelectric cell 42, it begins to receive light. This provides a signal to the motor 24 to reverse itself so as to cause the table 52 to move rearward. However, since the photoelectric cell 42 receives light before the piece of cloth 3 has been fully deposited on the table 52, a delay relay is used to delay the reverse signal from reaching the motor 24 so as to permit the piece of cloth 3 to be completely deposited on the table. As is shown in FIG. 3*b*, the table 52 is caused to be moved rearward until its rearward motion is stopped by the rear limit switch 34. The cycle is then repeated when the next piece of cloth 3 blocks light from being received by the photoelectric cell 42.

The operation of the clutch wheels in guiding and stacking the fabric will be described, as shown in FIG. 1. Located on horizontal element 80 is cross member 82. Suspended along cross member 82 are one or a plurality of clutch wheels 84 located so that the wheels roll against the fabric deposited on table top 52 on carriage 50. The wheels roll in only one direction. When the forward horizontal motion of carriage 50 stops and rearward motion occurs, the clutch wheels 84 freeze, causing the wheels to momentarily clutch the fabric and direct the fabric off table 52 and on to stacking table 86 (not part of the invention). Stacking table 86 is a standard elevator table and its height can be adjusted so as to facilitate the formation of stacks of different heights.

While the invention has been described in connection with its preferred embodiment, it will be understood that it is not intended to limit the invention to that embodiment. On the contrary, it is intended to cover all alternatives, modifications, and equivalents as may be included within the spirit and scope of the invention as defined by the claims.

What is claimed is:

1. An apparatus for stacking pieces of cloth which comprises: a frame;

a conveyor means, connected to said frame, adapted to receive a plurality of pieces of cloth in sequence; a reciprocating carriage connected to said frame, positioned below said conveyor means and adapted to move parallel with respect to the longitudinal axis of said conveyor means, so that cloth pieces are sequentially deposited on said reciprocating carriage and then are deposited on a receiving table that is situated below the reciprocating carriage; and a stationary cross member having one or more arms extending therefrom and supporting one way rotatable wheels, positioned above said reciprocating carriage and located so that the wheels touch and guide pieces of cloth as the pieces of cloth are sequentially deposited on said reciprocating carriage, and located so that the wheels stop and grip the pieces of cloth when the reciprocating carriage changes direction, so as to remove the pieces of cloth from the reciprocating carriage surface and so as to stack the cloth on the receiving table.

2. The apparatus of claim 1 wherein the conveyor means includes a pair of spaced rollers having a plurality of bands encompassing said pair of rollers.

3. The apparatus of claim 2 which includes a photoelectric cell that acts as a switch to control a motive means which causes horizontal movement of the reciprocating carriage when the amount of light reaching the photoelectric cell is varied due to the positioning of the cloth on the conveyor.

4. The apparatus of claim 3 wherein the receiving table has means to adjust its height so that the top of the stack of cloth that is located on said receiving table is kept at a predetermined distance from the surface of the reciprocating carriage.

5. The apparatus of claim 4 wherein the wheels supported by said arms only move in a clockwise direction.

6. The apparatus of claim 5 wherein the horizontal movement of the reciprocating carriage is at the same rate as the movement of the conveyor means.

7. A method of stacking pieces of cloth which comprises:

conveying pieces of cloth, by means of conveyor means, to a reciprocating carriage at a predetermined rate; causing the reciprocating carriage to move horizontally at the same rate and in the same direction as the conveyor means;

guiding the pieces of cloth off the reciprocating carriage so that they form an orderly stack on a receiving table, by means of clutch wheels that move only in a clockwise direction as they are guiding the cloth on the reciprocating carriage and that stop moving, and, in doing so, grip the cloth when the reciprocating carriage changes direction so as to move rearward;

moving said reciprocating carriage rearward after it receives a piece of cloth from the conveyor means and after the cloth is guided off the reciprocating carriage so that the reciprocating carriage is in a position to move forward again to received the next piece of cloth; and moving said receiving table downward so that the top of the stack of cloth formed on the receiving table is kept at a predetermined distance from the horizontally moving reciprocating carriage's surface.

* * * * *